US006148553A

United States Patent [19]

Billet

[11] Patent Number: 6,148,553

[45] Date of Patent: Nov. 21, 2000

[54] ADVERTISING PIECE ARRANGED FOR ATTACHMENT TO A PORTABLE DISPENSER

[75] Inventor: Robert L. Billet, North Wales, Pa.

[73] Assignee: Robert Billett Promotions, Inc., Horsham, Pa.

[21] Appl. No.: 08/847,417

[22] Filed: Apr. 24, 1997

[51] Int. Cl.[7] ..... A45C 15/00; G09F 1/08

[52] U.S. Cl. ..... 40/538; 40/586; 222/175; 221/185

[58] Field of Search ..... 40/538, 306, 310, 40/586; 222/175; 221/185

[56] References Cited

U.S. PATENT DOCUMENTS

| | | | |
|---|---|---|---|
| D. 314,796 | 2/1991 | McGarrah | D20/5 |
| D. 350,987 | 9/1994 | Wright | D20/5 |
| D. 382,905 | 8/1997 | Antao et al. | D20/5 |
| D. 386,791 | 11/1997 | Antao et al. | D20/5 |
| D. 411,657 | 6/1999 | Simonis | D3/216 |
| 2,704,627 | 3/1955 | Brulin et al. | 222/175 |
| 3,559,362 | 2/1971 | Klober | 40/306 X |
| 5,358,770 | 10/1994 | Evans | 40/310 X |
| 5,561,930 | 10/1996 | Ashley et al. | 40/538 |
| 5,607,211 | 3/1997 | Henninger et al. | 312/204 |
| 5,611,457 | 3/1997 | Ash, Jr. | 221/185 |
| 5,921,435 | 7/1999 | Billet | 221/185 |

FOREIGN PATENT DOCUMENTS

| | | | |
|---|---|---|---|
| 212578 | 4/1955 | Australia | 222/175 |
| 9910 | 5/1905 | United Kingdom | 40/538 |

*Primary Examiner*—Cassandra H. Davis

*Attorney, Agent, or Firm*—Caesar, Rivise, Bernstein, Cohen & Pokotilow, Ltd.

[57] ABSTRACT

An advertising piece that is arranged for securement to a portable dispenser in which a beverage is retained for dispensing. The portable beverage dispenser is adapted to be worn on the back of a vendor. The beverages retained within the dispenser is also commonly packaged in single-serving containers, e.g., eight or twelve ounce bottles, cans, cups or cartons, usually bearing distinctive packaging designs including stylized trademarks, pictures, words and designs that enables the beverage manufacturer or merchant to distinguish its beverage from all other beverage products. The advertising piece is an enlarged version of the single-serving beverage container and includes an exterior surface that is configured to resemble the shape of a single-serving beverage container. The advertising piece may also include a rendering of enlarged trademark indicia, stylized words, pictures or designs or a combination thereof, which in total replicates the exterior surface of the sing e-serving beverage container. The advertising piece enables those attending the event to ascertain the identity of the beverage product being dispensed by the vendor and may give notice of the manner in which that product is being dispensed, i.e., in liquid form or packaged in single-serving containers.

10 Claims, 7 Drawing Sheets

FIG. 4
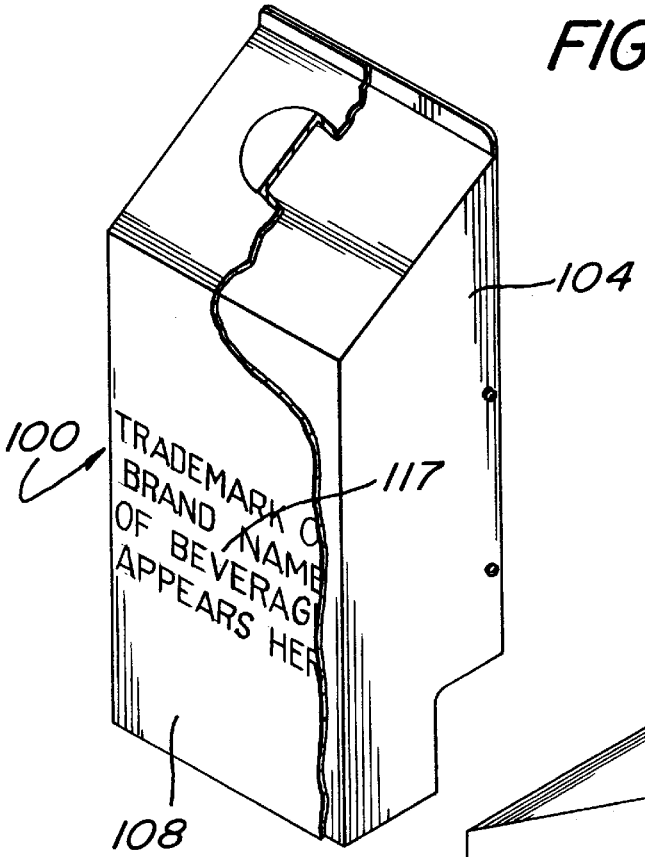
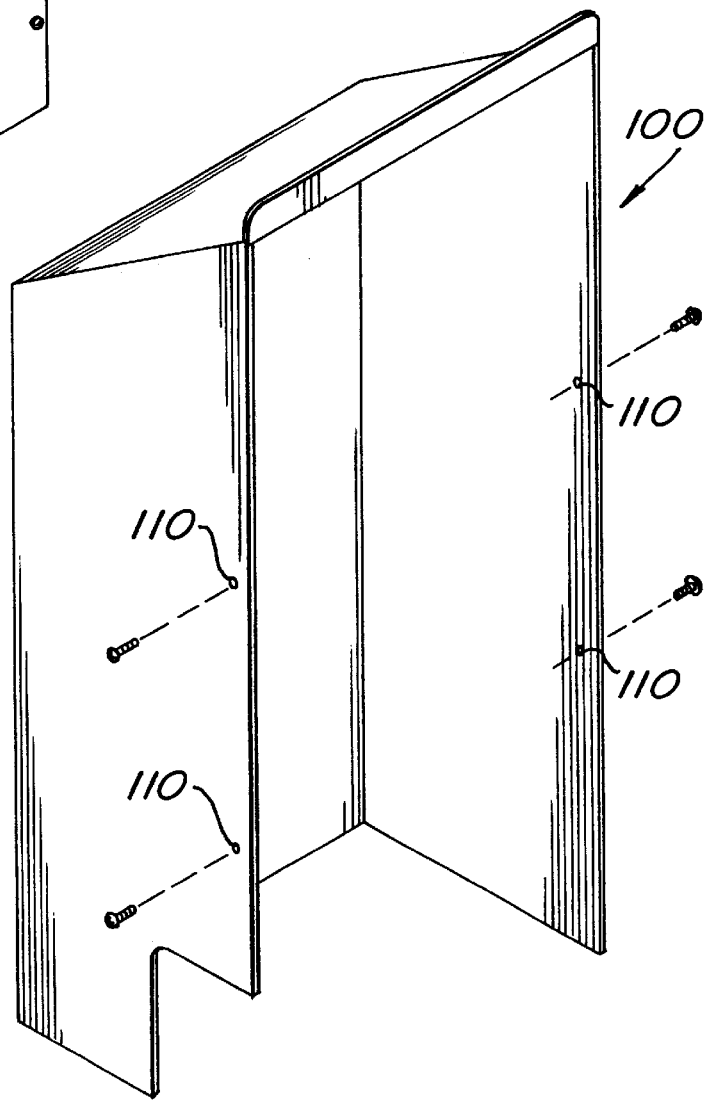
FIG. 5

FIG. 6
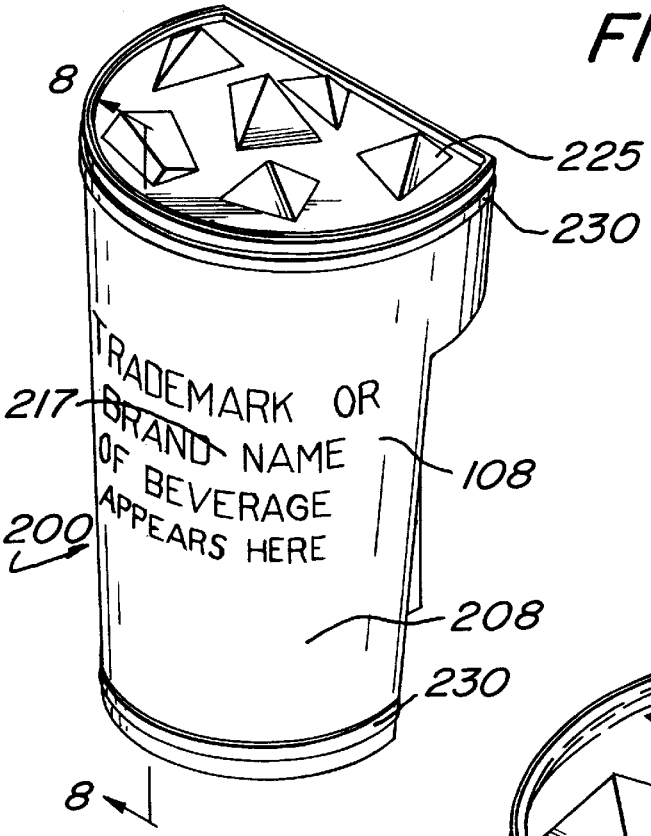
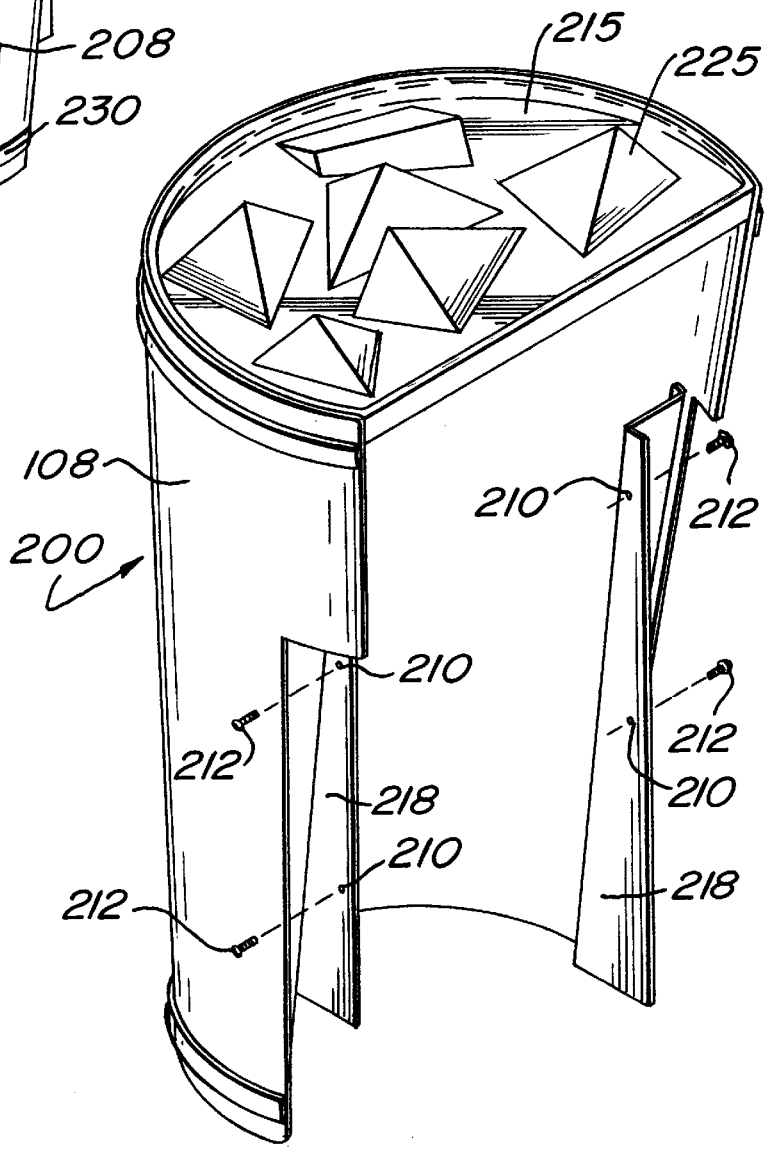
FIG. 7

FIG. 9
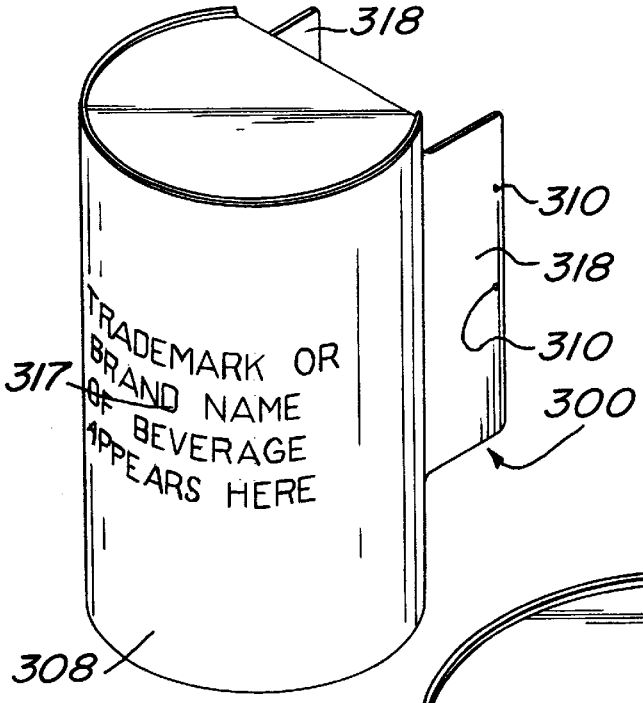
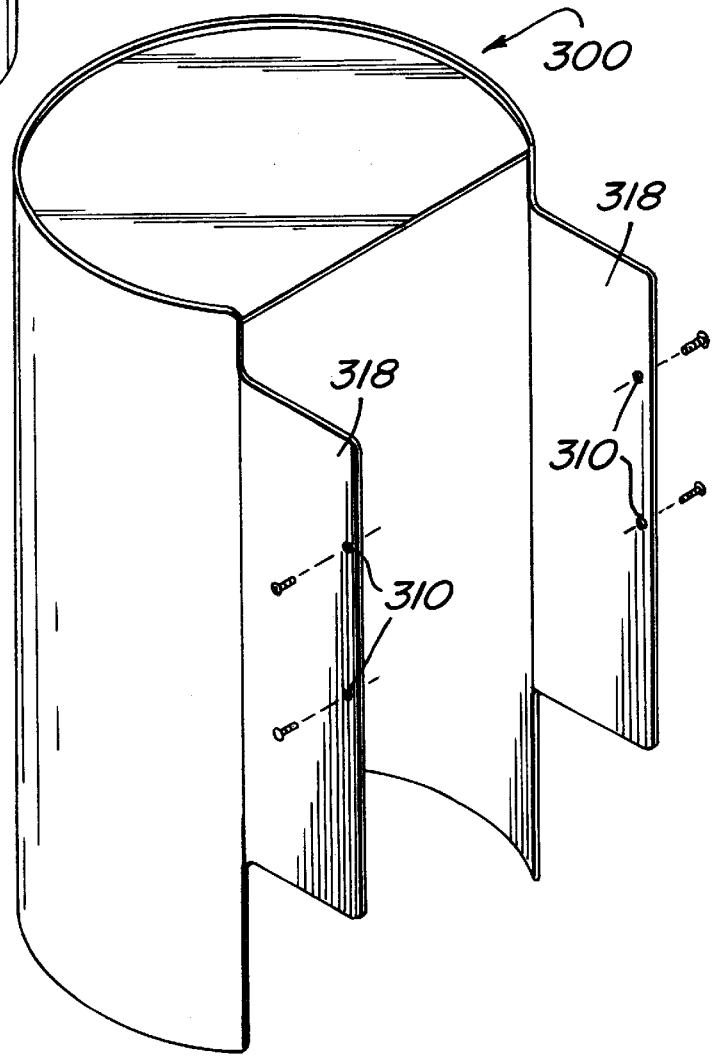
FIG. 10

ADVERTISING PIECE ARRANGED FOR ATTACHMENT TO A PORTABLE DISPENSER

BACKGROUND OF THE INVENTION

It is quite common at athletic events and other events which draw large crowds for vendors selling or dispensing hot and cold beverages to circulate among the crowd of people attending the event. For example, during sporting events, such as baseball and football games, it is common for vendors to carry containers of soda, beer, coffee, hot chocolate, etc., for sale to the fans.

OBJECTS CF THE INVENTION

Accordingly, it is a general object of this invention to provide an advertising piece for attachment to a portable beverage dispenser which overcomes the disadvantages of the prior art.

It is a further object of this invention to provide an advertising piece for attachment to a portable beverage product dispenser that is inexpensive to manufacture.

It is a further object of this invention to provide an advertising piece for attachment to a portable beverage product dispenser that is reliable in operation.

It is a further object of this invention to provide an advertising piece for attachment to a portable beverage product dispenser that is simple in construction.

It is a further object of this invention to provide an advertising piece for attachment to a portable beverage product dispenser that provides the vendor with hands free operation.

It is a further object of this invention to provide an advertising piece for attachment to a portable dispenser wherein the dispenser is arranged for dispensing beverages in liquid form.

It is a further object of this invention to provide an advertising piece for attachment to a portable dispenser wherein the dispenser is arranged for dispensing single-serving beverage containers, e.g., cans or bottles.

It is a further object of this invention to provide an advertising piece for attachment to a portable beverage product dispenser to enable the consuming public to ascertain the identity of the retained beverage being dispensed by the vendor.

It is a further object of this invention to provide an advertising piece for attachment to a portable beverage product dispenser to enable the consuming public to ascertain the manner in which the beverage is being dispensed therefrom, i.e., either in liquid form or in cans or bottles.

SUMMARY OF THE INVENTION

These and other objects of this invention are achieved by providing an advertising pieces that is arranged for securement to a portable dispenser in which a beverage either in liquid form or packaged in single-serving containers, e.g., bottles or cans, is retained for dispensing. The portable dispenser is adapted to be worn on the back of a vendor.

The beverages retained within these dispensers are also commonly packaged in single-serving containers, e.g., eight or twelve ounce bottles, cans, cups or cartons. The single-serving containers usually bear distinctive packaging designs including stylized trademarks, pictures, words and designs that enable the beverage manufacturer or merchant to distinguish its beverage from all other beverage products.

The advertising piece of this invention is an enlarged version of the single-serving beverage container. That is, the advertising piece includes an exterior surface that is configured to resemble the shape of a single-serving beverage container, e.g., a capped bottle, a can, a carton or a cup filled with the retained beverage with pieces of floating ice. The advertising piece also includes a rendering disposed over its exterior surface. The rendering may include enlarged trademark indicia, stylized words, pictures or designs or a combination thereof, which in total replicates the exterior surface of the single-serving beverage container. The advertising piece enables those attending the event to ascertain the identity of the beverage product being dispensed by the vendor and may notify those attending an event of the manner in which that product is being dispensed, i.e., in liquid form or packaged in single-serving containers.

DESCRIPTION OF THE DRAWINGS

Other objects and many attendant features of this invention will become readily appreciated as the same becomes better understood by reference to the following detailed description when considered in connection with the accompanying drawings wherein:

FIG. 4 is an isometric view of a second embodiment of the advertising piece of the present invention;

FIG. 5 is a second isometric view of the second embodiment of the advertising piece of the present invention illustrating mounting holes and attachment hardware;

FIG. 6 is an isometric view of a third embodiment of the advertising piece of the present invention;

FIG. 7 is a second isometric view of the third embodiment of the advertising piece of the present invention illustrating mounting holes and attachment hardware;

FIG. 9 is an isometric view of a fourth embodiment of the advertising piece of the present invention;

FIG. 10 is a second isometric view of the fourth embodiment of the advertising piece of the present invention illustrating mounting holes and attachment hardware.

DETAILED DESCRIPTION OF THE PREFERRED EMBODIMENTS

Figure 1:
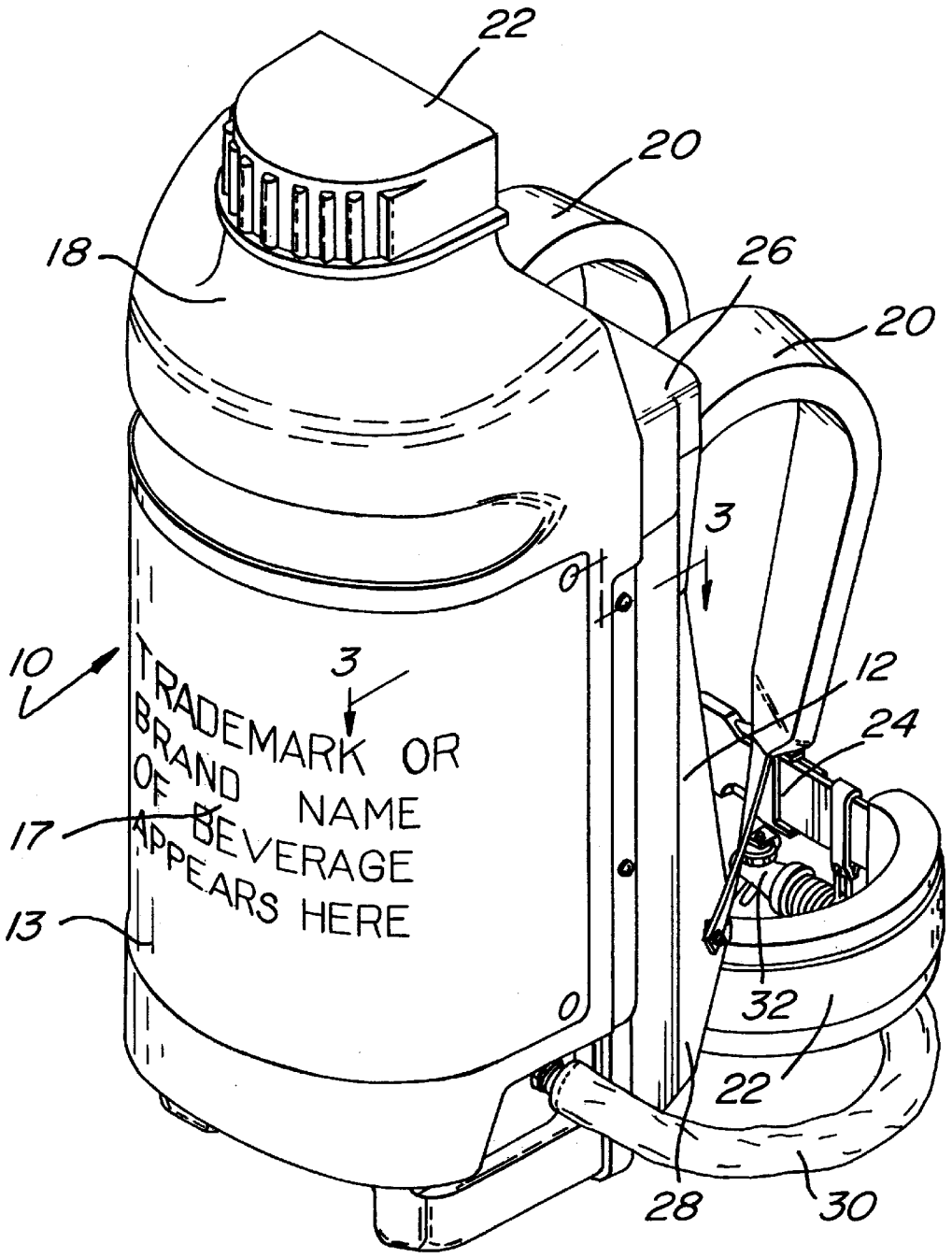
FIG. 1 is an isometric view of a first embodiment of the advertising piece of the present invention attached to a portable beverage dispenser.
Figure 2:
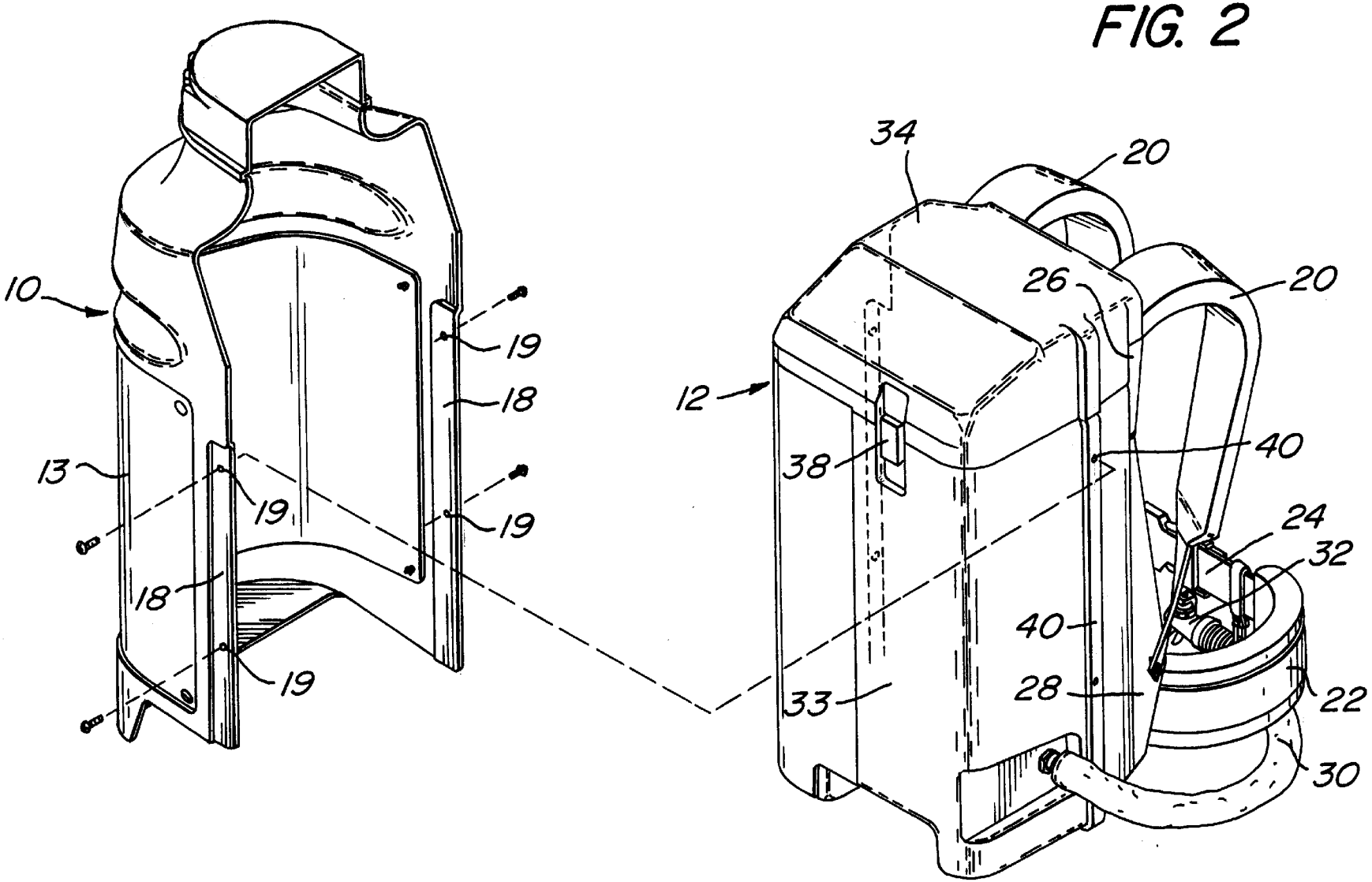
FIG. 2 is an isometric view of a first embodiment of the advertising piece of the present invention detached from a portable beverage dispenser.

Referring now in greater detail to the various figures of the drawings wherein like reference numerals refer to like parts there is shown at 10 in FIGS. 1 and 2 a preferred embodiment of a advertising piece constructed in accordance with this invention. The advertising piece 10 is shown in FIG. 1 as being attached to a portable dispenser 12 that is arranged for dispensing a beverage in liquid form. The dispenser 12 will be described in further detail below.

The advertising piece 10 is shaped to resemble the shape of a single-serving bottle used for packaging a popular brand of beverage. The advertising piece 10 is fabricated by conventional molding techniques and is constructed based upon the dimensions and configuration of the single-serving bottle. The advertising piece 10 is fabricated using any suitable material, e.g., polyethylene (PET), polyethylene terephthalate (PETG) or other specialty polymers such as those available from Eastman Chemical Company of Kingsport, Tennessee. The material used in fabricating the advertising piece 10 may be colored to replicate the appearance of the single-serving bottle as it appears when filled with the beverage.

These popular brand beverages are sold in single-serving containers under various stylized trademarks such as the Registered Trademark COCA-COLA of the Coca-Cola Company; the Registered Trademark BARQ'S of Barq's, Inc., the Registered Trademark POWERADE of the Coca-Cola Company and the Registered Trademark MINUTE-MAID of the Coca-Cola Company. The single-serving containers could be eight or twelve ounce bottles, cans, cups or cartons and usually bear distinctive packaging designs that include stylized trademarks (such as those mentioned above), pictures, words and designs that enable the beverage manufacturer or merchant to distinguish its beverage from all other beverages.

Figure 3:
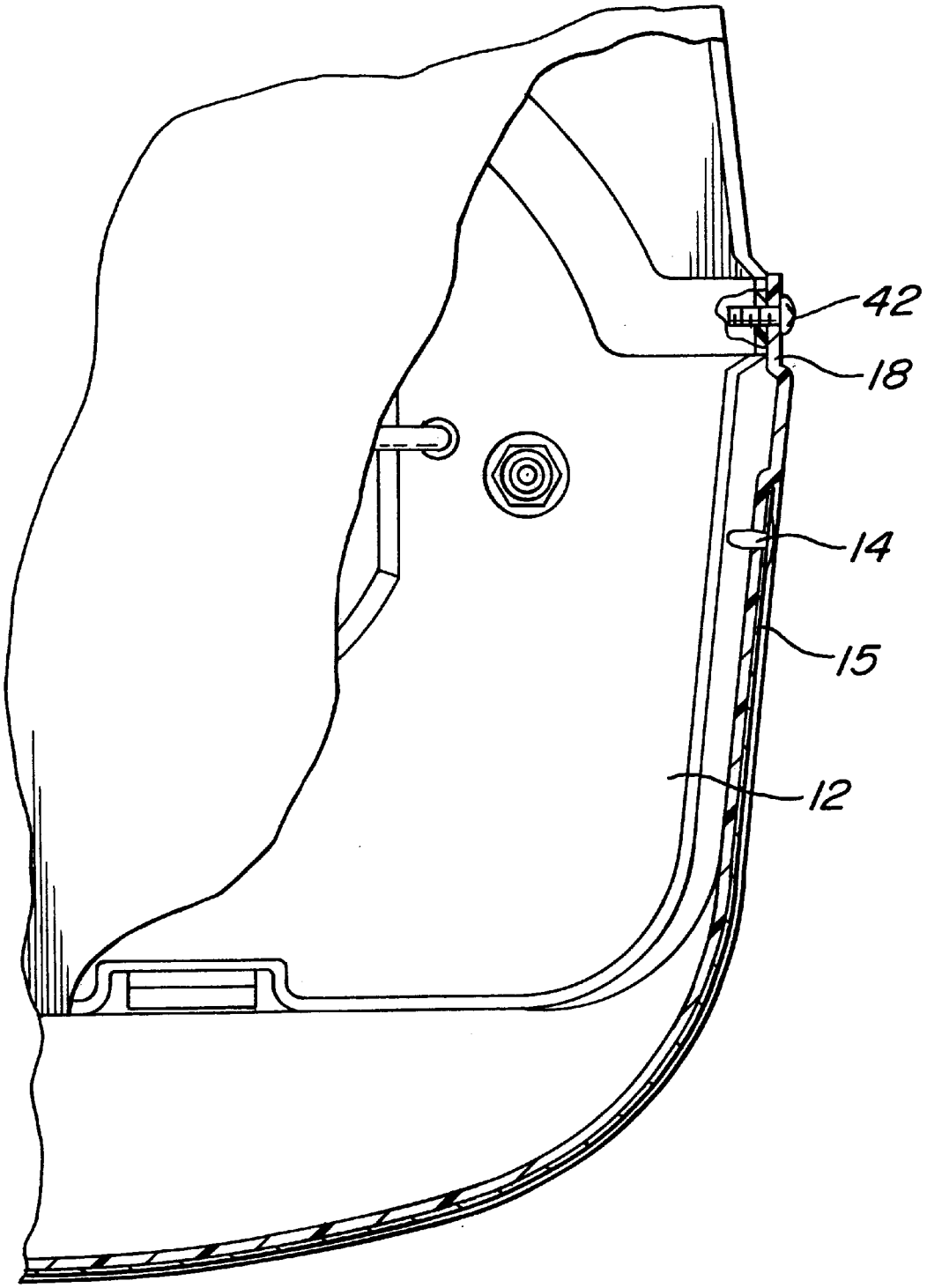
FIG. 3 is an enlarged sectional view taken along line 3—3 of FIG. 1.

Referring now to FIGS. 2 and 3, the advertising piece 10 is provided with a recessed surface 13 for placement and mounting of a thin film 15 (FIG. 3) bearing a rendering 17 containing an enlargement of the stylized beverage trademark, e.g., POWERADE, corresponding to the beverage being dispensed. The rendering 17 may also convey symbols or o:her types of information that are specific to the event at which the dispenser 12 is being utilized, i.e., Olympic ring symbols for use at the Olympic Games, a logo of a soccer player kicking a soccer ball for use at the World Cup, a Superbowl logo or Olympic downhill skiing logo, etc. The advertising piece 10 bearing the rendering 17 of the stylized beverage trademark enables consumers among the crowds attending these large athletic events to identify the type of beverage being sold by a vendor circulating among the crowd with the dispenser 12 strapped to his back. Because the advertising piece 10 is shaped to resemble a bottle it may also be used to indicate the manner in which the beverage is being dispensed, i.e., in bottles rather than in liquid form poured into cups.

As best shown in FIG. 3, the film 15 is mounted on the recessed surface 13 by any suitable hardware 14. One particularly effective type of mounting hardware is a black nylon fastener, Part No. 21099032, MMB-250-01 made by Richo Plastic Company of Chicago, Ill.

The film 15 may be of any suitable construction and one particularly effective film is formed of a polycarbonate-styrene construction and is available under the name 3M CONTROLTAC (TM) GRAPHIC MARKING SYSTEM by 3M Corporation. The enlarged stylized trademark portion of the rendering 17 is based upon art work depicting the mark as it appears on single serving-sized bottles. The enlarged trademark is created in a manner that is well-known in the art by utilizing one of several widely available graphic design software packages. Such software packages are available under the names QUARKXPRESS by Quark, Inc. of Denver Co., ILLUSTRATOR or PHOTOSHOP, both by Adobe Corporation of San Jose, California. The rendering 17 is first saved onto a magnetic disk and then applied directly to the polycarbonate-styrene film 15 using photographic techniques that are well-known in the art. Optionally, a clear flexible plastic laminate (not shown) could be mounted over the film 15 to protect the film from damage during use of the dispenser. As an alternative to applying the rendering 17 to a polycarbonate-styrene film, as previously described, the rendering 17 could be applied directly to a flexible plastic surface.

Referring now to FIGS. 2 and 3, the advertising piece 10 is provided with opposed mounting surfaces 18 that include through holes 19 that are sized to enable mounting of the advertising piece 10 to the dispenser 12. In particular, the mounting surfaces 18 are spaced apart a sufficient distance to enable the advertising piece to fit around the width of the dispenser's outer wall 33.

The portable dispenser 12, which is arranged for dispensing beverages in liquid form as opposed to dispensing cans or bottles of beverage, is this subject of my patent, U.S. Pat. No. 5,385,275, issued on Jan. 31, 1995, which is hereby incorporated by reference. The liquid beverage product dispenser 12 is provided with an internal insulated tank (not shown) in which liquid beverage product to be dispensed is retained, and from which the liquid beverage product is directed through a hose 30 and dispensing nozzle 32 and into a paper or plastic cup (not shown).

The retained liquid beverage product could be soda, beer, coffee, hot chocolate, etc, for sale to the fans. The liquid beverage product dispenser 12 comprises a hard plastic outer wall 33 that surrounds the insulated tank and a plastic cover 34 attached to the upper end of the wall 33 by a hinged connection (not shown), to permit the cover to be pivoted into a position overlying the insulated tank. The cover 34 is held in place over the insulated tank by a clasp 38.

As best shown in FIGS. 1 and 2, the liquid beverage product dispenser 12 is worn like a backpack and is provided with a pair of shoulder straps 20 adjustably interconnected through buckles (not shown) to permit proper adjustment of the shoulder straps 20 about the shoulders and upper chest region of the vendor to provide a level of comfort to the vendor while wearing the liquid beverage product dispenser 12 loaded with liquid beverage product. Still referring to FIG. 1, the beverage dispenser 12 also includes a waist strap 22 formed by a pair of waist strap segments each of which is adjustably connected to a buckle 24. The buckle 24 is preferably of the bayonet:-type construction providing for the quick connect and disconnect thereof. The liquid beverage product dispenser 12 is provided with additional padded surfaces 26 and 28, respectively, that correspond with the upper and lower sections of the vendor's back.

The liquid beverage product dispenser 12 is provided with threaded mounting holes 40 that are spaced apart a distance that corresponds with the through holes 19 located on the advertising piece 10 to enable mounting of the advertising piece 10 onto the liquid beverage product dispenser 12. As best shown in FIG. 3, the advertising piece 10 may be secured to the liquid beverage product dispenser 12 using suitable hardware 42, e.g., screws.

Referring now to FIGS. 4 and 5, there is shown at 100, a second embodiment of the form of the present invention. The second embodiment advertising piece 100 is shaped to resemble the configuration of a single-serving sized carton for containing a beverage such as orange juice. As described earlier in connection with the first embodiment 10, the advertising piece 100 is provided with through holes 110 to enable attachment to a portable dispenser such as that shown in FIGS. 1 through 3 at 12. Attachment of the advertising piece 100 to the dispenser is by use of suitable hardware 112, e.g., screws. The advertising piece 100 comprises a base portion 104 and a film portion 108 attached thereover. The base portion 104 is fabricated of any suitable material, e.g., thin aluminum sheet, by bending to arrive at the resulting configuration shown in FIGS. 4 and 5. The film portion 108 is provided with an adhesive back surface to enable adherence of the film portion to the base portion.

Over its entire exterior surface, the film portion 108 is provided with a rendering 117 that resembles the package design of the single-serving beverage carton. The rendering 117 is created by utilizing the package design of the single-serve carton and available graphic design software packages in the manner described in connection with the advertising piece 10. The rendering 117 may include stylized trademarks associated with a particular beverage, e.g., MINUTE MAID, and may include words in stylized form that appear on the single-serving sized carton, e.g., the words "NEW SENSATIONAL TASTE," "LIKE EATING A FRESH RIPE ORANGE," "PREMIUM," "100! PURE ORANGE JUICE FROM CONCENTRATE," and "ORIGINAL." The rendering 117 may also include pictures of the product, e.g., orange juice and cut oranges, to replicate the single-serving carton design. The advertising piece 100 may also include a cap 115 mounted near the top to replicate the single-serve package design.

Referring now to FIGS. 6 and 7, there is shown at 200, a third embodiment of the form cf the present invention. The third embodiment advertising piece 200 is shaped to resemble the configuration of a single-serving cup filled with a particular beverage such as root beer and pieces of ice floating therein. As described earlier in connection with the first embodiment 10, the advertising piece 200 is provided with mounting surfaces 218 that are spaced apart a sufficient distance to enable the advertising piece 200 to fit around the width of the dispenser's outer wall. Through holes 210 are provided to enable attachment of the advertising piece 200 to a portable dispenser such as that shown in FIGS. 1 through 3 at 12. Attachment of the advertising piece 200 to the dispenser is by use of suitable hardware 212, e.g., screws. The advertising piece 200 comprises a base portion (not shown) and a film portion 208 attached thereover. The base portion is fabricated of any suitable material, e.g., thin aluminum sheet, by bending to arrive at the resulting single-serving cup configuration shown in FIGS. 6 and 7.

Figure 8:
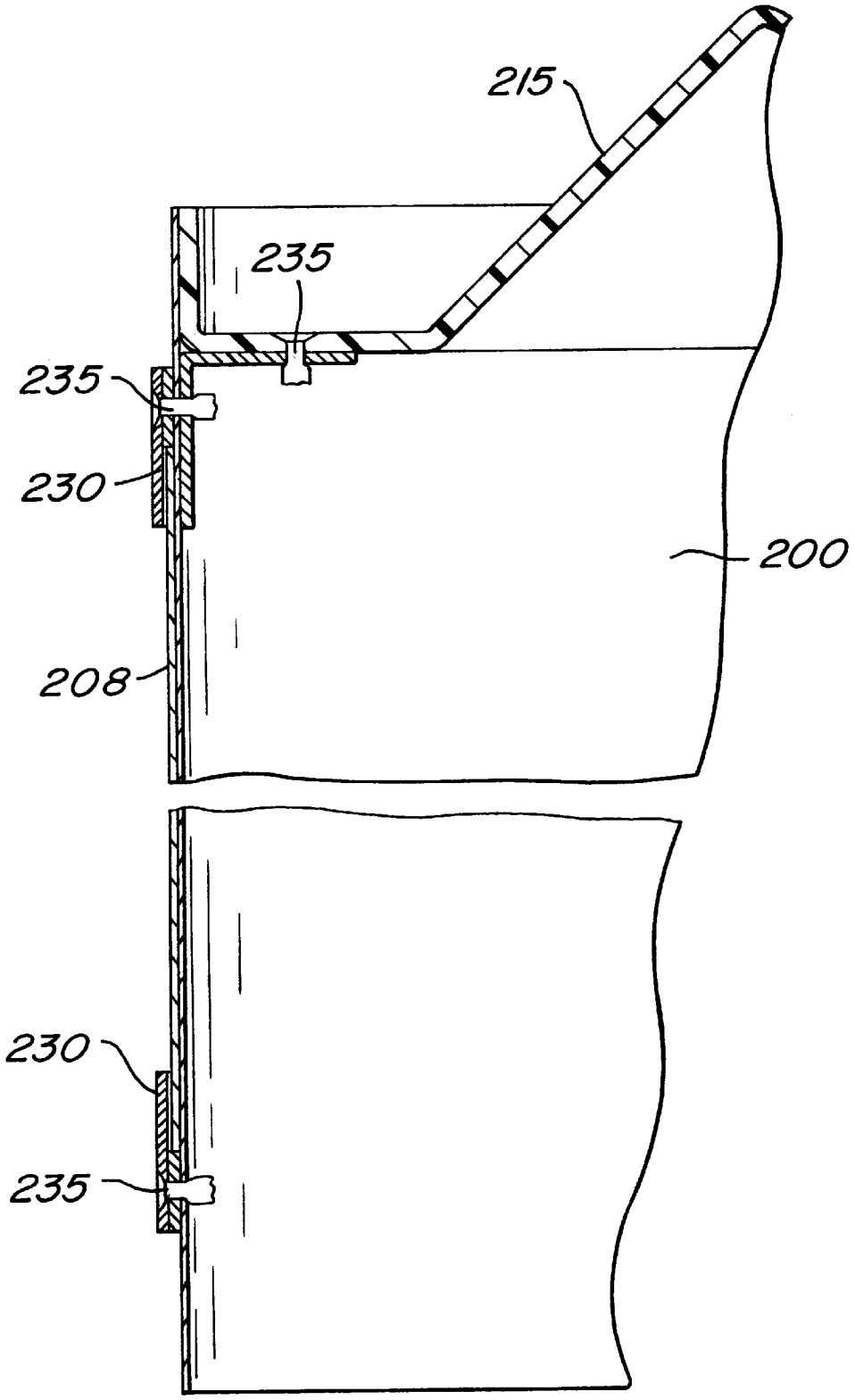
FIG. 8 is an enlarged sectional view taken along line 8—8 of FIG. 6.

The film portion 208 is provided with an adhesive inner surface to enable adherence of the film portion 208 to the base portion. Over its entire exterior surface, the film portion 208 is provided with a rendering 217 that resembles the package design of the single-serving cup. The rendering 217 is created based upon the package design of the single-serve cup and available graphic design software packages in the! manner described in connection with the advertising piece 10. The rendering 217 may include stylized trademarks associated with a particular beverage, e.g., BARQ'S, and may include other words in stylized form or designs that appear on a single-serving sized cup. The advertising piece 200 may also include a top portion 215 formed of painted acrylic plastic or another suitable materials to resemble beverage and ice cubes 225 floating therein. As best shown in FIG. 8, the top portion 215 attaches to the advertising piece using suitable hardware 235, e.g., screws. The advertising piece is also provided with plastic edging 230 in order to prevent the film portion 208 from peeling away from the base portion during use. As best shown in FIG. 8, the plastic edging 230 attaches near the base and at the lip of the advertising piece 200 using suitable hardware 235, e.g., screws.

Referring now to FIGS. 9 and 10, there is shown at 300, a fourth embodiment of the advertising piece of the present invention. The fourth advertising piece 300 is shaped to resemble the configuration of a single-serving can of a particular beverage such as soda. As described earlier in connection with the first embodiment 10, the advertising piece 300 is provided with mounting surfaces 318 that are spaced apart a sufficient distance to enable the advertising piece 300 to fit around the width of the dispenser's outer wall. Through holes 310 are provided on the mounting surfaces 318 to enable attachment to a portable dispenser such as that shown in FIGS. 1 through 3 at 12. The advertising piece 300 comprises a base portion (not shown) and a film portion 308 attached thereover. The base portion is fabricated of any suitable material, e.g., thin aluminum sheet, by bending to arrive at the resulting single-serving can configuration shown in FIGS. 9 and 10.

The film portion 308 is provided with an adhesive surface to enable adherence of the film portion 308 to the base portion. Over its entire exterior surface, the film portion 308 is provided with a rendering 317 that resembles the package design of the single-serving can. The rendering 317 is created based upon using the package design of the single-serve can and available graphic design software packages in the manner described in connection with the advertising piece 10. The rendering may include stylized trademarks associated with EL particular beverage and may also include other words in stylized form or designs that appear on the single-serving sized can.

At this juncture, it is important to point out that the dispenser 12, arranged for d:spensing liquid products, is merely exemplary. The various embodiments of the advertising piece of the present invention are also arranged for securement to backpack dispensers that are arranged for dispensing beverages products packaged in cans and bottles without departing from the spirit of this invention.

For example, rather than being attached to liquid beverage product dispensers such as that described and shown at 12 in the figures, the various embodiments of the advertising piece described herein are also arranged for attachment to portable dispensers that dispense beverage products packaged in cans and/or bottles as opposed to dispensing a liquid product. Examples of backpack dispensers arranged for dispensing cans and/or bottles rather than beverages in liquid form are disclosed in my patent application entitled PORTABLE BACKPACK DISPENSER FOR BEVERAGE CONTAINERS, now U.S. Pat. No. 5,921,435 filed on Apr. 23, 1997, the disclosure of which is hereby incorporated by reference. The various embodiments of the advertising pieces described herein are arranged for attachment to the can and bottle dispensers disclosed in the aforementioned pending application in a conventional manner and using suitable conventional hardware, e.g., nuts, bolts and washers.

In this manner, an advertising piece 10 shown in FIGS. 1 through 3 configured in the shape of bottle may be secured to a backpack dispenser arranged for dispensing bottles of a particular beverage to inform the consuming public that a vendor wearing the backpack dispenser is vending bottles of that beverage, e.g., bottles of POWERADE rather than in liquid form. An advertising piece 300 resembling a can as shown in FIGS. 9 and 10 may be attached to a portable backpack dispenser arranged for dispensing cans of a particular beverage to inform the consuming public that a vendor wearing the backpack dispenser is vending cans of that beverage rather than in liquid form.

Likewise, an advertising piece 200 of a cup filled with pieces of ice may be attached to a portable backpack dispenser arranged for dispensing a particular beverage in liquid form such as that described at 10 to inform the consuming public that a vendor wearing the backpack dispenser is dispensing that beverage into cups rather than packaged. in bottles or cans.

Without further elaboration the foregoing will so fully illustrate my invention that others may, by applying current or future knowledge, adapt the same for use under various conditions of service.

What is claimed is:

1. A portable advertising and dispensing device comprising:

a. an advertising piece;

b. a portable beverage product dispenser adapted to be worn by a vendor; and, c. a beverage product retained within said portable beverage product dispenser for dispensing at events that draw consumers, said retained beverage product being provided in combination with said device and otherwise being available for sale in containers bearing trademark indicia recognizable to the consumers, said advertising piece being secured to said dispenser by securement means and having an enlarged exterior surface shaped to resemble the container to enable the consumers to ascertain the identity of said retained beverage product being dispensed by the vendor, said dispenser including a housing portion in which said beverage product is retained for dispensing and being provided with adjustable strap means to enable the vendor to wear said dispenser, said advertising piece further including an interior concave surface that is arranged to substantially envelop and conceal from view said housing portion when said advertising piece is secured to said dispenser.

2. The portable advertising and dispensing device of claim 1 additionally comprising a rendering disposed on the enlarged exterior surface of said advertising piece, said rendering comprising the trademark indicia for identifying the retained beverage product.

3. The portable advertising and dispensing device of claim 2 wherein said advertising piece is configured to resemble the shape of a capped bottle.

4. The portable advertising and dispensing device of claim 2 wherein said advertising piece is configured to resemble the shape of a cup.

5. The portable advertising and dispensing device of claim 2 wherein said advertising piece is configured to resemble the shape of a cup filled with the retained beverage and pieces of floating ice.

6. The portable advertising and dispensing device of claim 2 wherein said advertising piece is configured to resemble the shape of a juice carton.

7. The portable advertising and dispensing device of claim 1 wherein said advertising piece is configured to resemble the shape of a can.

8. The portable advertising and dispensing device of claim 1 wherein the beverage product dispenser is arranged for dispensing a beverage in a liquid form.

9. The portable advertising and dispensing device of claim 1 wherein the beverage product dispenser is arranged for dispensing cane.

10. The portable advertising and dispensing device of claim 1 wherein the beverage product dispenser is arranged for dispensing bottles.

* * * * *